US008403193B2

(12) United States Patent
Chan

(10) Patent No.: US 8,403,193 B2
(45) Date of Patent: Mar. 26, 2013

(54) SHOULDER STRAP CHEST SYSTEM FOR A PACK

(75) Inventor: Man Chan, Tai Po (CN)

(73) Assignee: NIFCO (HK) Ltd., Tai Po, N.T. HK (CN)

( * ) Notice: Subject to any disclaimer, the term of this patent is extended or adjusted under 35 U.S.C. 154(b) by 661 days.

(21) Appl. No.: 12/535,411

(22) Filed: Aug. 4, 2009

(65) Prior Publication Data

US 2010/0181355 A1 Jul. 22, 2010

(30) Foreign Application Priority Data

Jan. 22, 2009 (CN) ..... 2009 2 0001858 U

(51) Int. Cl.
*A45F 3/04* (2006.01)

(52) U.S. Cl. ..... 224/638; 224/262

(58) Field of Classification Search ..... 224/262, 224/264, 578, 637, 638, 639, 667; 2/304, 2/305, 323, 327; 24/301, 302, 532
See application file for complete search history.

(56) References Cited

U.S. PATENT DOCUMENTS 305,606 A * 9/1884 Lawrence ..... 2/333
326,162 A * 9/1885 Shelby ..... 2/305
1,410,306 A * 3/1922 Hoffmann et al. ..... 24/300
4,327,852 A * 5/1982 Gibson ..... 224/627
5,540,364 A * 7/1996 Krieger et al. ..... 224/153
5,566,397 A * 10/1996 Scott ..... 2/338
5,935,044 A * 8/1999 Brewster ..... 450/86
5,961,019 A * 10/1999 Gleason et al. ..... 224/643
5,984,157 A * 11/1999 Swetish ..... 224/631
6,006,364 A * 12/1999 Newsom et al. ..... 2/323
6,163,937 A * 12/2000 McKinnis et al. ..... 24/302
6,808,099 B2 * 10/2004 Nykoluk ..... 224/638
6,923,357 B2 * 8/2005 Smith ..... 224/605
7,805,816 B1 * 10/2010 Thorne et al. ..... 24/301
2007/0152007 A1 * 7/2007 Kauss et al. ..... 224/637

* cited by examiner

*Primary Examiner* — Justin Larson
*Assistant Examiner* — Todd Anderson
(74) *Attorney, Agent, or Firm* — Pillsbury Winthrop Shaw Pittman, LLP

(57) ABSTRACT

A shoulder strap chest system for a pack including at least one shoulder pad, includes: at least one slot on the shoulder pad, at least one hook hooked at the slot detachably, and at least one connection strap, at least one end of which is attached to the hook in a length-adjustable way, wherein the width of the hook matches that of the slot so that the hook is prevented from sliding when the hook is hooked at the slot.

9 Claims, 3 Drawing Sheets

SHOULDER STRAP CHEST SYSTEM FOR A PACK

CROSS-REFERENCE TO RELATED APPLICATIONS

This application is based upon and claims the benefit of priority from prior Chinese Patent Application No. 200920001858.4, filed Jan. 22, 2009, the entire contents of which are incorporated herein by reference.

TECHNICAL FIELD

The present invention generally relates to a shoulder strap chest system for a pack, in particular, to a shoulder strap chest system which allows free attachment in a simple way without slipping.

BACKGROUND

The existing shoulder strap chest system for a pack, as shown in FIG. 2, consists of slipping ladders 9, 10 at left side strap 14 and right side strap 15 respectively, and a middle fastener 11 for adjusting the connecting strap 12. The connecting strap 12 is connected to two shoulder pads 16, 17. The left side strap 14 and the right strap 15 are sewn on the shoulder pads 16, 17 respectively. The existing shoulder strap chest system is disadvantageous in that slipping ladders 9, 10 are not available for free attachment and can slip on the strap of the shoulder pad, which brings about troubles to users.

SUMMARY

The present invention provides a shoulder strap chest system for a pack including at least one shoulder pad, the system comprising: at least one slot on the shoulder pad, at least one hook hooked at the slot detachably, and at least one connection strap, at least one end of which is attached to the hook in a length-adjustable way, wherein the width of the hook matches that of the slot so that the hook is prevented from sliding when the hook is hooked at the slot.

Preferably, the hook includes a curved end, a clip lock, an entrance, and a tail in that order, wherein the tail is located away from the curved end and includes a wide ladder passage and two finger grip located at both sides of the wide ladder passage respectively.

Preferably, the pack includes two shoulder pads and the system comprises at least one pair of hooks and at least one pair of slots, each slot of one pair arranged at the same level along the shoulder pads, the number of the hooks being two times of that of the connection straps, and each end of each connection strap attached to one hook.

Preferably, the system comprises one pair of the hooks and one connection strap.

Preferably, the system comprises more than one pair of the hooks and a plurality of connection straps.

Preferably, one end of the connection strap is attached to one hook in a length-adjustable way, and the other end of the connection strap is attached fixedly to another hook.

Preferably, both ends of each connection strap are attached to two hooks in a length-adjustable way respectively.

Preferably, the system comprises a plurality pairs of slots arranged in lengthwise direction of the shoulder pad, each pair of slots positioned at different levels of the shoulder pad.

Preferably, the pack includes one shoulder pad, one hook and one connection strap, one end of the connection strap attached to the hook in a length-adjustable way, and the other end of the connection strap fixed on the pack.

Preferably, a slotted material is sewn on the shoulder pad.

THE DETAIL DESCRIPTION OF AN EMBODIMENT

Figure 1:
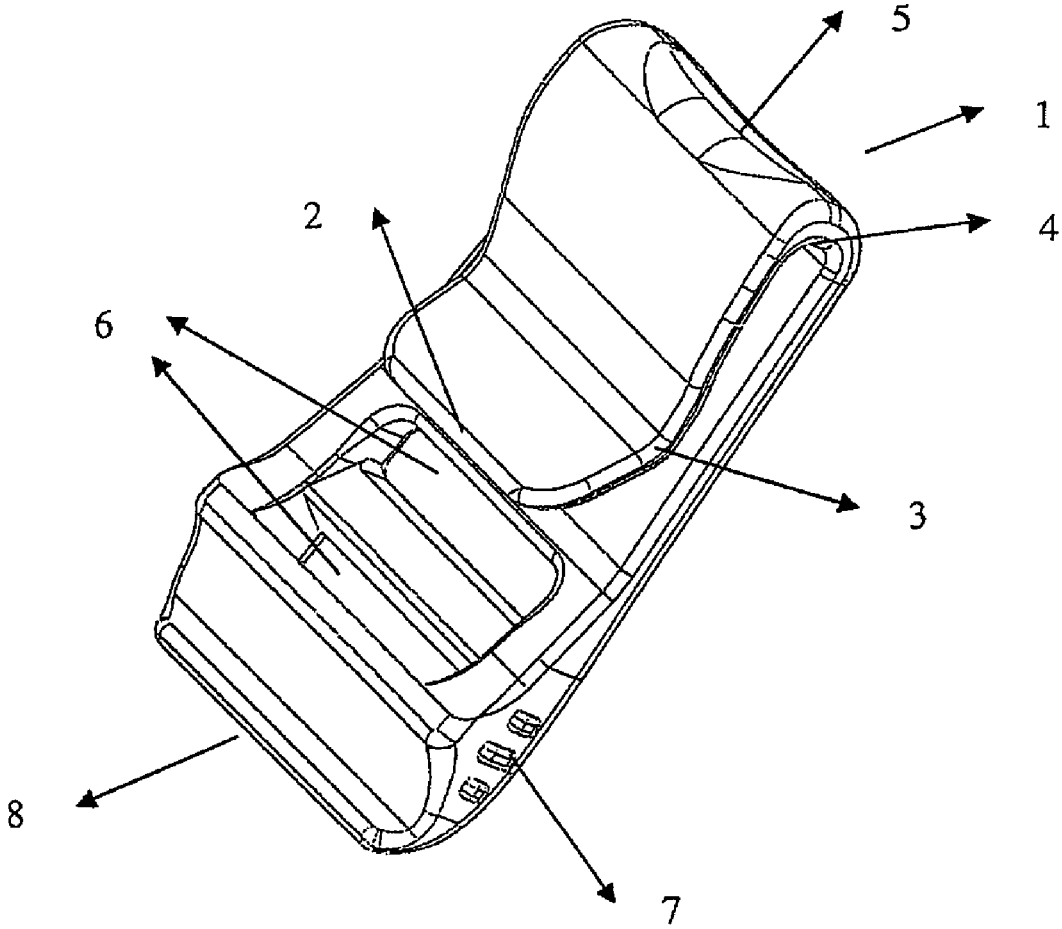
FIG. 1 is a perspective view illustrating an embodiment of a hook according to the present invention.
Figure 2:
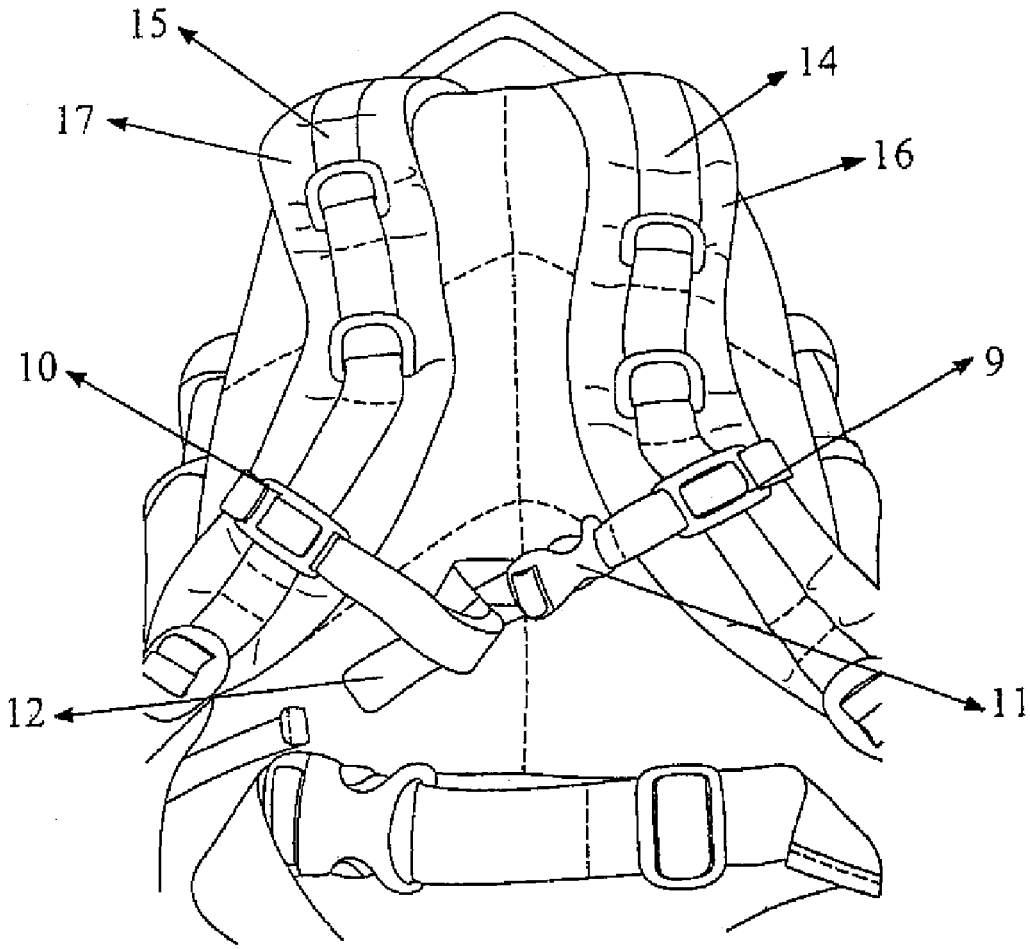
Fig. 2 (Prior art)
FIG. 2 is a perspective view illustrating a shoulder strap chest system in prior art.

FIG. 1 is a perspective view illustrating an embodiment of a hook according to the present invention. The hook 1 shown in FIG. 1 includes a curved end 4, a clip lock 3, an entrance 2, and a tail 8 in that order, wherein the tail 8 is located away from the curved end 4 and includes a wide ladder passage 6 and two finger grips 7 located on both sides of the wide ladder passage 6 respectively. An object can be hooked up through the entrance 2 and the curved end 4. In this way, hook 1 is detachably attached to the object. A strap can pass through the space provided by the wide ladder passage 6 and thus can be attached thereto in a way well known with its length being adjustable. Alternatively, the strap can be fixed to the hook 1.

Figure 3:
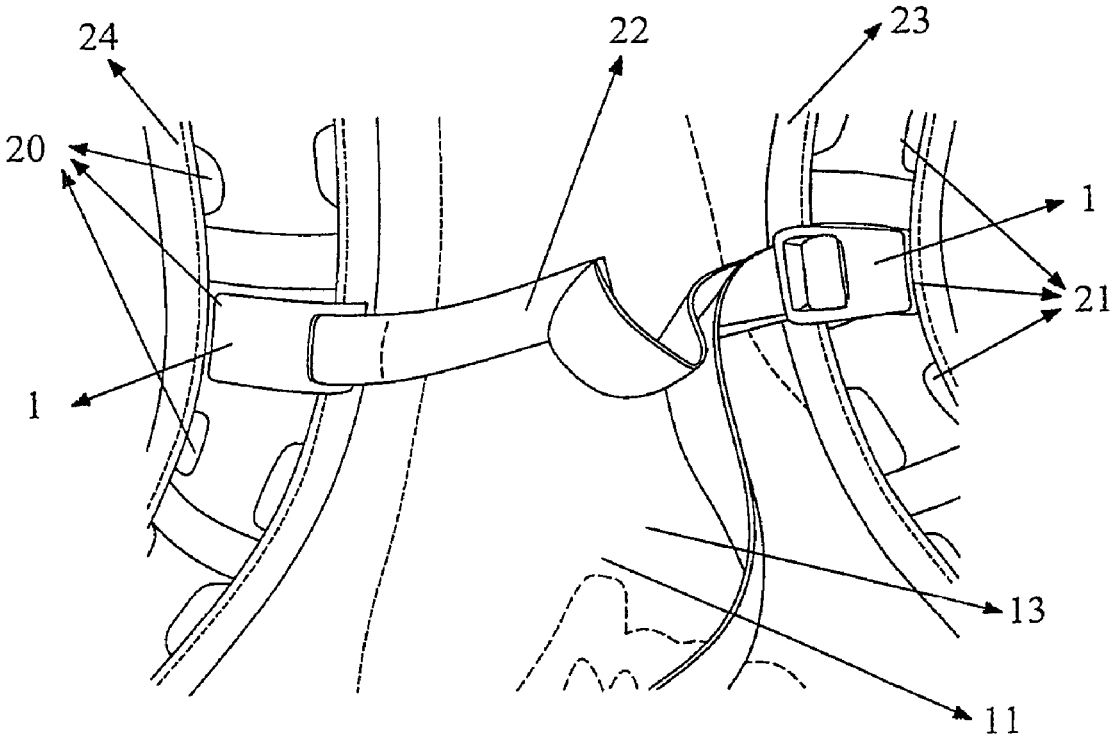
FIG. 3 is a perspective view illustrating an embodiment of the shoulder strap chest system according to the present invention.

Now referring to FIG. 3, a shoulder strap chest system according to the present invention includes two hooks 1 hooked at a left side slot 20 and a right side slot 21, and a connecting strap 22 connected to shoulder pads 23, 24 by attaching to hooks 1 hooking at the slots 20, 21. At least one end of the connecting strap 22 is attached to the hook 1 in a length-adjustable way. Each of the left side slot 20 and the right side slot 21 includes at least one slot and can be arranged in pair(s) on the shoulder pads 23, 24 respectively. FIG. 3 shows more than one pair of slots 20, 21 and each slot 20 is arranged at the same level as the corresponding slot 21 along the shoulder pads 23, 24 as shown in FIG. 3. It can also be conceived that different pairs of slots 20, 21 are arranged at different levels along the shoulder pads 23, 24. The slots 20/21 are formed for example through sewing any slotted material e.g. cloth on the shoulder pad 24/23 so that a plurality of slots 20/21 are separated from each other along the length of the shoulder pad 24/23. The width of each slot 20/21 matches that of each hook 1 to prevent the hook 1 hooked at the slots 20/21 from sliding in lengthwise direction, as shown in FIG. 3.

It is apparent from the above description that the hooks 1 can be attached freely or detachably to any pair of slots 20, 21 at different levels without sliding, which is prevented by the slots 20, 21 on the shoulder pads 23, 24. In addition, the middle fastener is not necessary in the present system, since the length of the strap can be adjusted by hooks 1. Thus, the present invention provides a shoulder strap chest system which allows free attachment in a simple way without slipping.

The embodiment described can be modified and varied without departing from the spirit of the invention. For example, in an embodiment, the hook 1 can be replaced by other hooks carrying out same function. In other embodiments, the number of the hooks and/or the slots can be modified. As an example, only one hook is used with one or more slots in only one shoulder pad. In this case, one end of the strap is attached to the hook and the other end is fixed to e.g.

the body of the pack. It is contemplated that all these modifications and variations fall in the scope of the attached claims.

The invention claimed is:

1. A pack, comprising:

at least one shoulder pad;

at least one slot formed on the shoulder pad;

at least one hook that is hooked into the slot detachably; and at least one connection strap, at least one end of which is attached to the hook in a length-adjustable way, wherein the width of the hook matches that of the slot so that the hook is prevented from sliding along the slot when the hook is hooked into the slot;

wherein a material is sewn to the shoulder pad along the lateral sides of the material; and wherein each said slot has a transverse passage defined between the material and the shoulder pad by forming two cutouts or slits at both lateral sides of the material, so that said slot can be hooked by the hook.

2. The pack according to claim 1, wherein the hook includes a curved end, a clip lock, an entrance, and a tail in that order, wherein the tail is located away from the curved end and includes a wide ladder passage and two finger grip located at both sides of the wide ladder passage respectively.

3. The pack according to claim 1, wherein the pack includes two shoulder pads and the system comprises at least one pair of hooks and at least one pair of slots, each slot of one pair arranged at the same level along the shoulder pads, the number of the hooks being two times of that of the connection straps, and each end of each connection strap attached to one hook.

4. The pack according to claims 3, wherein the pack comprises one pair of the hooks and one connection strap.

5. The pack according to claims 3, wherein the pack comprises more than one pair of the hooks and a plurality of connection straps.

6. The pack according to claim 4, wherein one end of the connection strap is attached to one hook in a length-adjustable way, and the other end of the connection strap is attached fixedly to another hook.

7. The pack according to claim 4, wherein both ends of each connection strap are attached to two hooks in a length-adjustable way respectively.

8. The pack according to claim 4, wherein the pack comprises a plurality pairs of slots arranged in lengthwise direction of the shoulder pad, each pair of slots positioned at different levels of the shoulder pad.

9. The pack according to claim 1, wherein the pack includes one shoulder pad, one hook and one connection strap, one end of the connection strap attached to the hook in a length-adjustable way, and the other end of the connection strap fixed on the pack.

* * * * *